US008376564B2

(12) United States Patent
Finn

(10) Patent No.: US 8,376,564 B2
(45) Date of Patent: Feb. 19, 2013

(54) FASHION ILLUMINATION SYSTEM

(76) Inventor: Bruce L. Finn, Malibu, CA (US)

( * ) Notice: Subject to any disclaimer, the term of this patent is extended or adjusted under 35 U.S.C. 154(b) by 0 days.

(21) Appl. No.: 12/975,122

(22) Filed: Dec. 21, 2010

(65) Prior Publication Data

US 2012/0002402 A1 Jan. 5, 2012

Related U.S. Application Data

(62) Division of application No. 11/945,240, filed on Nov. 26, 2007, now Pat. No. 7,878,675.

(60) Provisional application No. 60/860,907, filed on Nov. 24, 2006.

(51) Int. Cl.
*F21V 21/08* (2006.01)

(52) U.S. Cl. ..... 362/103; 362/108; 362/249.02; 362/249.03; 362/249.06; 362/311.02; 362/800; 362/806; 2/905; 450/1; 607/88

(58) Field of Classification Search ..... 2/905, 906; 362/103–108, 249.02–249.06, 311.02, 800, 362/806; 607/88; 450/1, 94
See application file for complete search history.

(56) References Cited

U.S. PATENT DOCUMENTS

| | | | | |
|---|---|---|---|---|
| 2,866,462 | A | 12/1958 | Faron | 128/429 |
| 3,595,243 | A | 7/1971 | Mount | 128/469 |
| 4,602,191 | A | 7/1986 | Davila | 315/76 |
| 5,113,325 | A | 5/1992 | Eisenbaum | 362/103 |
| 5,183,324 | A | 2/1993 | Thomas | 362/103 |
| 5,440,461 | A | 8/1995 | Nadel et al. | 362/303 |
| 5,577,828 | A | 11/1996 | Nadel et al. | 362/103 |
| 5,904,607 | A | 5/1999 | Abadi | 450/3 |
| 6,045,575 | A * | 4/2000 | Rosen et al. | 607/88 |
| 6,174,075 | B1 | 1/2001 | Fuwausa | 362/310 |
| 6,663,256 | B1 * | 12/2003 | Gobbell | 362/104 |
| 7,144,830 | B2 | 12/2006 | Hill et al. | 442/205 |
| 7,195,369 | B2 | 3/2007 | Shaw | 362/108 |
| 7,878,675 | B2 * | 2/2011 | Finn | 362/108 |
| 2005/0125874 | A1 * | 6/2005 | DeVore | 2/69 |
| 2006/0039165 | A1 | 2/2006 | Harris et al. | 362/65 |

FOREIGN PATENT DOCUMENTS

DE 20 2006 008 561 U1 11/2006

OTHER PUBLICATIONS

International Search Report and the Written Opinion of the International Searching Authority, or the Declaration, PCT/US2007/085542, Jul. 4, 2008.
Fiberoptic Light Jackets, printout from website lightgod.com, dated Nov. 7, 2006.
Enlighted Designs Inc. light-up bras, printout from website, dated 2000-2008.
Enlighted Designs Inc. lighted vests, printout from website, dated 2000-2007.
Enlighted Designs Inc. suit jackets with LEDs, printout from website, dated 2000-2007.
Lumigram, Light for Style, Clothing Collection, printout from website, dated Nov. 28, 2007.
Lumigram, Light for Style, Fashion Collection 2008, printed Nov. 2007.

* cited by examiner

*Primary Examiner* — Stephen F Husar
(74) *Attorney, Agent, or Firm* — Irell & Manella LLP

(57) ABSTRACT

A fashion apparel accessory, such as a garment, having one or more concealed light sources positioned so as to illuminate the skin of the wearer, as opposed to focusing attention on the light sources themselves. A particular embodiment includes concealed light sources proximate to a low-cut neckline of a female's garment, such as brassiere, shirt, or item of lingerie, with the light sources being oriented so as direct illumination across the wearer's chest area in an alluring way, potentially offering multiple color, intensity, direction/control options as well as multiple deployment techniques/devices. A portable power supply is integrated with the garment or accessory and electrically connected to the light sources.

10 Claims, 6 Drawing Sheets

FASHION ILLUMINATION SYSTEM

RELATED APPLICATION INFORMATION

This application is a divisional of U.S. patent application Ser. No. 11/945,240, filed Nov. 26, 2007, which claims the benefit of U.S. Provisional Application Ser. No. 60/860,907, filed on Nov. 24, 2006, both of which are hereby incorporated by reference as if set forth fully herein.

BACKGROUND OF THE INVENTION

1. Field of the Invention

The field of the present invention relates to fashion, beauty, jewelry, apparel and accessories, and more particularly to illumination-based products, systems or devices intended to accentuate the human form. These light emitting devices, associated systems and methods of lighting may be useful, for example in the fashion arena as accessories, attached temporarily or permanently sewn into garments, free hanging as jewelry, or adhered directly to the skin to position said devices in an advantageous and aesthetically pleasing way.

2. Description of the Related Art

Fashion is an integral part of modern society, and many individuals spend countless hours attempting to improve their looks through clothing, accessories, and the like. For some people, such as models or celebrities, fashion is a part of their profession, and new and interesting looks are continuously sought after. In addition, many everyday consumers seek unique fashions or strive to enhance their appearance. In some cases they seek to emulate the fashion trend-setters in the public eye, and in other cases they simply seek a way to create a unique and personal look.

One aspect of female's clothing that started as a practical garment and has evolved into a fashion-related item is the brassiere. Over the years, the brassiere has undergone many changes. For example, while the brassiere was at one time a method of concealment, it has evolved into a tool to enhance the shapeliness of the wearer. This transformation has been evidenced in recent years by the extreme popularity of cleavage enhancing bras and brassieres. In the past, undergarments relied upon various techniques to improve the bust line of the wearer by, e.g., enhancing the cleavage. For example, U.S. Pat. No. 3,595,243 issued to Mount describes a brassiere constructed to elevate the breasts of the wearer when the brassiere is secured around the chest. That patent describes an uplift system which operates independently for each breast in that it uses tension created by two separate independent stays, one for each breast. Another technique is described in U.S. Pat. No. 2,866,462 to Faron, describing an up-lift brassiere. In that patent, the uplifting method is again separate for each breast. These prior brassiere designs do not necessarily provide optimal aesthetics for the wearer.

U.S. Pat. No. 5,904,607 to Abadi describes a brassiere incorporating a "V"-shaped tensioner interposed between the breast cups so as to effectively "squeeze the breasts together" in combination with an "underwire which is structured and disposed to wrap substantially around each breast of the wearer so as to effectively lift the breasts upwardly." The objects of this device include providing "an improved brassiere which is structured and disposed not only to greatly enhance the cleavage of the wearer but to be adjustable so that the wearer can adjust the amount of cleavage enhancement."

While the above prior brassieres attempt to enhance the female figure, they do so primarily by mechanically supporting or shaping the chest area. Thus, they are limited by the extent to which they can physically support or re-shape the chest area. Nonetheless, it Appears that cleavage enhancement is greatly desired and there is a long standing need for further improvement in this area.

One way to achieve another dimension of fashionability is by adding illumination to a garment. Illuminated bras or brassieres and other forms of lingerie, clothing and costumes incorporating light-emitting diodes (LEDs) or other light emitting devices can be found in the market.

Some examples include, for instance, Janet Hansen's Enlightened® product lines. A product line of bras has LEDs sewn or mounted to the exterior of the bra and along the neckline for instance. These are eye catching products that illuminate mostly the garment and draw your eye to the apparel and the light source. Another Enlightened® product is an LED-illuminated camisole. With that garment, a row of LEDs is mounted within a flexible strip that attaches to the camisole with velcro, between the outer fabric layer and a built-in bra. The LEDs shine through the fabric, for a subtle effect, and they may twinkle and fade back and forth in a variety of hypnotic patterns.

Another provider of illuminated apparel is www.lightgod.com. Among the types of apparel offered at this website are "light up" bras and corsets. These products appear to utilize electro-luminescent (EL) wire in various patterns similar to threading patterns, on the sides or near the edges (on the exterior) of the bra or corset. EL wire generally consists of concentric layers, with an inner layer of solid copper coated with an aluminum phosphor, two fine wires wrapped around the phosphor, a surrounding clear or colored plastic sheath, and an outer plastic skin layer. The phosphor emits light when subjected to an AC current, supplied via the fine wires and the copper conductor. A high voltage may be needed to make the wire glow brightly. In some instances, flashy designs and shapes mostly made with EL wire sewn on to the outside surface create changing hearts, spirals and other patterns. Much like other conventional illuminated garments, the illumination and attention is drawn to the apparel and its striking effect.

Other garments use lights or illumination to spell out changing words or phrases on a display. This can be done, for example, on the front of a shirt or in a border on the neckline of a bra. One manufacturer offers a bra with a display that scrolls risqué messages.

Illuminated lingerie is also made by Kelly Butler and marketed under the trade name "Tramp Lamps." Such products are offered at www.tramplamps.com. These lingerie products appear to resemble a "lamp shade" that is illuminated from within by a small (e.g., 25 Watt) incandescent light bulb. They are designed to be stiff and durable, like a lampshade, and do not appear to be designed to be worn, but rather as decorative light fixtures.

Thus, although there are brassieres that enhance appearance through mechanical design and illuminated brassieres or garments that are attention-getting apparel, existing garments do not adequately utilize illumination to actually enhance the human form and, in particular, the female figure. Conventional illuminated garments are largely designed to outline the curves of the body by outwardly projecting light to the viewer. A significant advancement in the fashion arts would be a system or method for enhancing a person's natural figure by either illumination or a combination of mechanics and illumination, or by overcoming other limitations or drawbacks in the art. It would also be separately advantageous to provide a products or method to beautifully accentuate the female form, through an illuminated apparatus, in an evocative and alluring way.

SUMMARY OF THE INVENTION

The present invention relates, in certain aspects, to fashion, beauty, jewelry, apparel and accessories, and more particularly to products, systems or devices intended to accentuate the beauty of the female form and, in particular settings, the bustline. These light emitting devices, associated systems and methods of lighting may be useful, for example in the fashion arena as accessories, attached temporarily or permanently sewn into garments, free hanging as jewelry, attached to the skin via skin tape, piercings or other methods to position said devices in the most advantageous way to illuminate the wearer's skin, for example in the chest area (e.g., cleavage) between and/or the breasts themselves. The device may provide indirect or direct light that is projected across the cleavage and/or breasts, resulting in an illuminating effect that enhances the wearer's form and is perceived by viewers as sexually appealing.

Embodiments of the invention relate, in one aspect to a fashion apparel accessory, such as a garment, having one or more concealed light sources positioned so as to illuminate the skin of the wearer, as opposed to focusing attention on the light sources themselves. A particular embodiment includes concealed light sources proximate to a low-cut neckline of a female's garment, such as brassiere, shirt, or item of lingerie, with the light sources being oriented so as direct illumination across the wearer's chest area in an alluring way, potentially offering multiple color, intensity, direction/control options as well as multiple deployment techniques/devices. The light sources may be fastened, built in, attached or independently mounted. A portable power supply is preferably integrated with the garment or fashion accessory and electrically connected to the light sources. Other embodiments may include a "self powered" power source where the skin itself, heat, motion, friction, static, solar or other forms of energy may be used to power the device or recharge a power storage device (such as a rechargeable battery).

Quality, quantity, color and direction/control of illumination are important in viewing of any desired object(s), both to the eye and photographically/cinemagraphically. The innovative products and methods described herein and can be utilized to beautifully accentuate a woman's form, illuminating the cleavage, breasts, and/or body/skin in an evocative, alluring, and versatile manner.

DESCRIPTION OF PREFERRED EMBODIMENT(S)

Figure 1A:
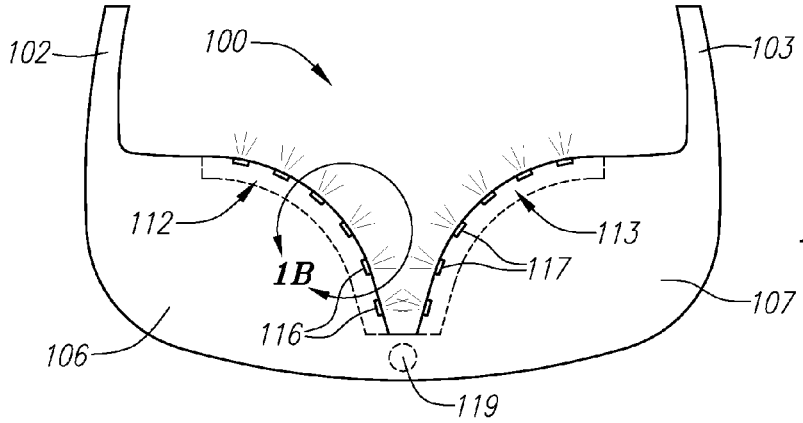
FIG. 1A is a diagram of an illuminated garment (e.g., a brassiere) with light sources for illuminating the chest area of a wearer, according to one embodiment as disclosed herein.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

One preferred embodiment incorporates one or more light emitting diodes (LEDs) or other light sources which can be attached or located, for example, on a garment or fashion accessory near the wearer's chest area, e.g. alongside or circumnavigating a female wearer's cleavage or breasts and oriented (potentially adjustably) to send a spray of soft direct and/or ambient light across, in between and/or upwards between the breasts to create a provocative and alluring illuminated view of them. The LED(s) or other light producing device(s) is/are intended to be a source of illumination, but the emitter itself may be hidden or shielded from view, such that only the resultant light is seen.

There are a multitude of options in terms of how to locate the illumination device including being affixed to the center point (the point between the cups) of an improved cleavage-enhancing "Wonder" type brassiere for example. This could be accomplished in a permanent "built in" or as a detachable accessory to be used with multiple garments. It may also be desired to have the light source fashioned in a way that would allow mounting with "skin" or Microspore tape in the desired location, to be mounted as a "piercing" or dangled from a chain or other means like jewelry all resulting in the desired effect of illuminating the skin (in particular the cleavage/breasts) in a desirable fashion. Such an illumination device would preferably be powered independently, and be configured in a compact, easily fastened and hidden (e.g., substantially flat) manner. One or more small flat batteries could be utilized to provide power, as in many common LED devices. It may also be possible to "self power" the device through one's skin, heat, motion, friction, static electricity or solar storage, for example.

As well as a single central source illuminator, it may be desirable in certain embodiments (such as a "cleavage enhancing brassiere") to include additional or alternative illumination of the bustline along the upper edge or neckline of the brassiere. The combined illumination source (using multiple light sources) would "spray" or glow from the upper edge or wire of the brassiere in such a way as to illuminate the exposed skin area of the breasts starting at the point where they are covered by the brassiere's top wire/edge, and glowing upwards. It may also be desirable to illuminate the underside of the breasts or "Australian cleavage" (neathage) by locating light source(s) along the underwire. In other embodiments, it may also be desirable to illuminate the upper legs, hips and/or buttocks, for example from the back hem of a short skirt or undergarment.

Possible light sources may be based upon fiber optic "side emitting" materials, fiber optic center-emitting multiple fibers, a multitude of individual tiny LEDs woven into a "strand", a linear array of LEDs, or arrays of LEDs encapsulated in a plastic or resin to shape or diffuse the LED output light. Printed circuit board or printed wiring board materials (flex circuits) may provide an advantageous flexible mounting substrate allowing for adjustability and pliability. An array or LEDs, for example, may be encapsulated in a silicone "ribbon," in a linear arrangement, where the LED light emits from the edge of from the ribbon. Spacing the LEDs at a desired distance within the silicone (or other possibly translucent/transparent flexible material) may not only serve to support their orientation, wiring, electronics, and so on, but also can form a watertight heat-insulated flexible ribbon that could be easily sewn into a garment hem. It may be advantageous to score, slit or remove small wedge or other shaped slices of the material in between the LEDs in order to allow the light ribbon to bend properly to achieve the correct shape, for instance around the upper edge of a brassiere cup facing outward so that light illuminates the tops of the breasts. Such a light ribbon may be attached to the inside of the brassiere cup, or else could be attached to the outside of the garment or incorporated into the garment (e.g., sandwiched between fabric). It may be desirable to make the light ribbon with a wide bull-nosed edge along an otherwise flat body, so that fabric can be fit or sewn into the "step" along the flat body up to the ribbon's edge, and the ribbon thus becomes the garment edge when sewn or fastened (as described in more detail with respect to FIGS. 11A-11B hereafter).

Other types of light sources that may be used include cold-cathode fluorescent, chemoluminescence, gas discharge devices, laser or phosphorescent sources, electro-luminescent (EL) wire or tape, composite electro-luminescent (CEL), and so on. It may be important to raise the light source from the skin surface slightly to allow for sufficient upwards or downwards light radiation/illumination. Side-emitting sources could be usefully sewn into the border material of a translucent/sheer/lace undergarment (e.g., thong) or brassiere, thus illuminating the wearer's body beneath the apparel. The view of the illuminate body through this translucent/sheer material would be analogous to viewing an illuminated object through theatrical scrim in the theatre or motion picture environment. When utilized in a brassiere, side emitting light sources could also be used without sheer cup material, as in a "cupless" bra embodiment where the breasts/cleavage could be illuminated from the underwire, strap/center point between the cupless bra underwires thus illuminating the breasts/cleavage in an alluring and provocative way.

Various examples and embodiments will now be described in more detail with reference to the accompanying drawings.

Figure 1B:
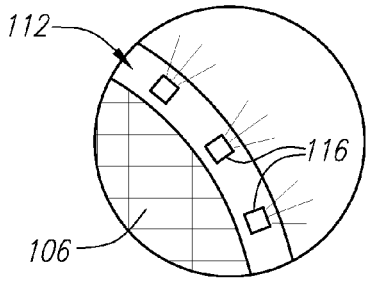
FIG. 1B is a reverse-angle enlargement of a portion of FIG. 1A.

FIG. 1A is a diagram of an illuminated garment (e.g., a brassiere) 100 with a plurality of light sources 116, 117 for illuminating the chest area of a wearer, according to one embodiment as disclosed herein. In FIG. 1A, the brassiere 100 may have conventional straps 102, 103 and support cups 106, 107, typically comprised of fabric material with padding if desired and a support structure of concealed wires or other similar support, stitched internally into the hems or in other areas of the brassiere. The light sources 116, 117 can be embodied as LEDs, or other semiconductor based light sources, and, in particular, may be part of a pair of flexible LED strips 112, 113 (shown more clearly in the reverse angle of FIG. 1B) which can be located along the upper periphery of the support cups 106, 107 in a manner concealing the light sources 116, 117 from view but still allowing their illumination to "wash over" the skin area of the wearer's chest, providing a upwardly radiating soft light on the wearer's breasts. An effect of the cross-cleavage light may be to illuminate the exposed skin of the upper breast area, thus providing subtle emphasis, while at the same time shadowing the cleavage thus creating the illusion of deeper or larger breasts. By concealing the light sources 116, 117 themselves, which are preferably disposed beneath the top edge of the cup supports 106, 107 (as shown in FIG. 1B's reverse angle for instance), the illuminated garment 100 would divert attention from the light sources themselves, and the relatively strong or sharp light that would be perceived from directly viewing them, to the wearer (and particularly the wearer's exposed skin in the chest area) by virtue of the light being directed across the wearer's body.

The light ribbon strips 112, 113 may be self-adhesive, and/or they may be attached by threading, straps, or other means. Mounting or sewing a preferably translucent silicone (or other material) ribbon with suspended or attached LEDs or other light emitting sources 116, 117 therein, to a curved surface may be facilitated by providing scoring/slits along the edge(s) of the light ribbon strips 112, 113. The scoring or slits would provide enhanced flexibility for bending along the "short" side of the ribbon/strips. The LED strips 112, 113 may also have a stepped shape, with a raised edge portion at the end of an otherwise flat ribbon surface, to allow an optimal beam angle and distance from the body, as further described with respect to the example in FIGS. 11A-11B. Such a "step" in the ribbon strip might, for example, facilitate attachment to the edge of a hem and allow the raised portion of the ribbon strip to in effect become the leading edge of the hem.

An example of one possible commercially available LED product that may be used for LED strips 112, 113 is the LINEAR light FLEX Side LED flexible LED strip available from Osram Sylvania (based in Danvers, Mass.). The LINEARlight flexible LED strip can be cut into modules of, e.g., four or more LEDs, and is available in various colors including red/amber, green, blue, yellow and white. Any of these colors may be utilized in the FIG. 1A garment, or other colors if available, or else a mix of colors (including RGB) may be used. Another possible LED product that may be used is the LED flexible light ("I-type"), such as model FL10-T, available from ATEX Corporation of Japan. The LEDs can be powered by a low-voltage source 119 such as a battery, which in the example of FIG. 1A is illustrated as being located in a concealed position at the center support adjoining the right and left support cups 106, 107. The central location is preferable because it generally has a concealed wire support which will mask the presence of the battery or similar power source, will cause minimal discomfort for the wearer, and is evenly positioned between the left and right LED strips 112, 113 thus minimizing wiring. The low voltage source 119 (in FIG. 1A and in other embodiments) may comprise, for example, a set of (e.g., three) low voltage double-A batteries, or any other suitable batteries.

Figure 2A:
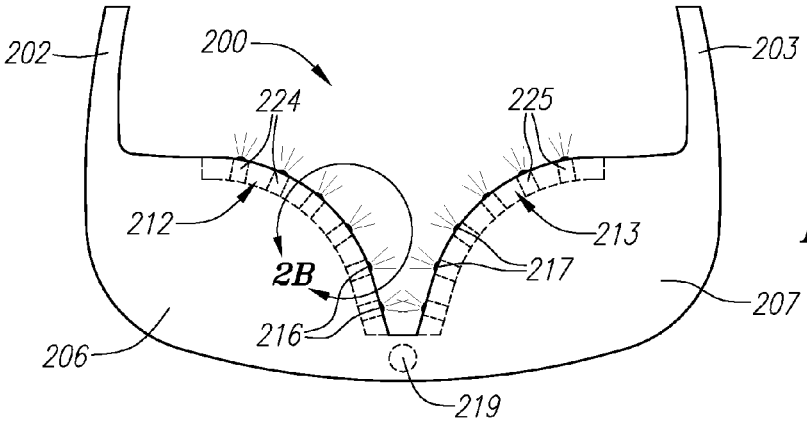
FIG. 2A is a diagram of another embodiment of an illuminated garment (e.g., a brassiere) with light sources for illuminating the chest area of a wearer.
Figure 2B:
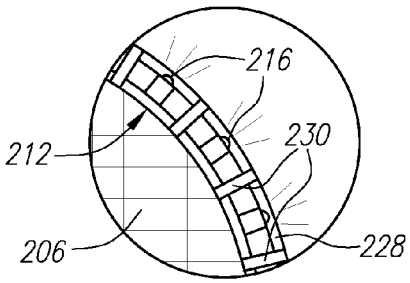
FIG. 2B is a reverse-angle enlargement of a portion of FIG. 2A.

FIG. 2A is a diagram showing another embodiment of a garment (e.g., a brassiere) 200 with light sources 216, 217 for illuminating the chest area of a wearer. As with FIG. 1A, the brassiere 200 may have conventional straps 202, 203 and support cups 206, 207, as previously described. The light sources 216, 217 in this example can again be embodied as LEDs, or other semiconductor based light sources. In this particular embodiment, the light sources 216, 217 are encased in soft, flat ribbons 212, 213 which are perhaps best seen from the reverse angle diagram of FIG. 2B. The ribbons 212, 213 may be made of a flexible plastic, vinyl, soft silicone, fabric, or other flexible material, and may be translucent in nature to allow the illumination to spread through the ribbon body. Diffusion may also be achieved by embedding diffuse material in the ribbon 212, 213, or else by making the silicone itself "cloudy" with the addition of pigment or other substance to act as diffusion. The ribbons 212, 213 may have a set of "pockets" 224, 225 in which the various light sources 216, 217 are disposed. The ribbons 212, 213 may be sewn into the hems along the upper periphery of the support cups 206, 207, or else, as shown in FIG. 2B, may be looped like a belt through fabric loops 230 (like beltloops) along the inner upper periphery of the support cups 206, 207. The ribbons 212, 213 may be secured by Velcro, straps, hooks, snaps, or other means, to keep them in place.

As with FIG. 1A, the light sources 216, 217 when located along the upper periphery of the support cups 206, 207 may be concealed from view but still provide illumination "washing over" the skin area of the wearer's chest, providing a soft "wash" light. As before, one effect of the cross-cleavage light may be to illuminate the exposed skin of the upper breast area, thus providing subtle emphasis, while at the same time shadowing the cleavage thus creating the illusion of deeper or larger breasts. The light sources 216, 217 may be any desired color or mix of colors, and may be powered by a low-voltage source 219 such as a battery, which in the example of FIG. 2A is again illustrated as located in a concealed position at the center support adjoining the right and left support cups 206, 207.

Advantageously in various embodiments, the ribbons 212, 213 may be removable so that the illuminated garment 200 may be washed or cleaned without risking damage to the light sources 216, 217. Also, different ribbons 212, 213 with, e.g., different numbers of LEDs or different color LEDs or color mixes, may be swapped into the illuminated garment 200 to allow the wearer to create different illuminated effects, or change the intensity of lighting. A wide variety of other light sources may also be used, as noted previously, including chemoluminescence sources, phosphorescent sources, or EL wire or tape. Flexible "rope" type light bands may also be used. In each case, the light sources are preferably substantially concealed from view, with only the resultant light washing across the wearer being primarily observable.

Figure 11A:
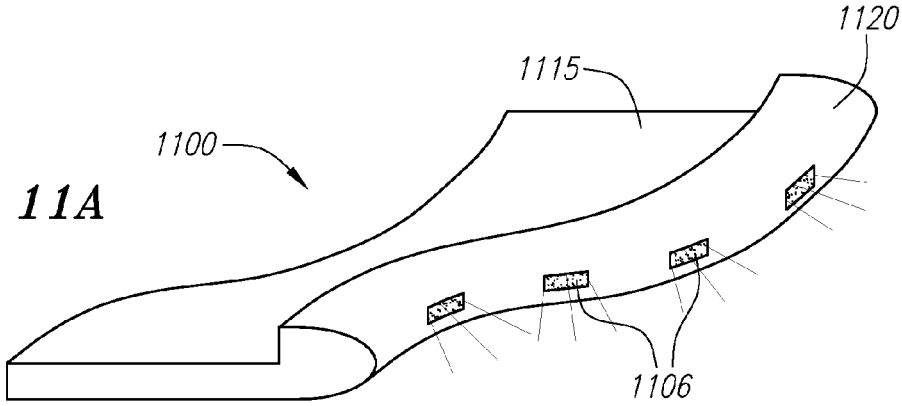
FIGS. 11A and 11B are diagrams of a light ribbon with integral semiconductor light elements (e.g., LEDs), as may be used in an illuminated garment in accordance with various embodiments as disclosed herein to illuminate the wearer.
Figure 11B:
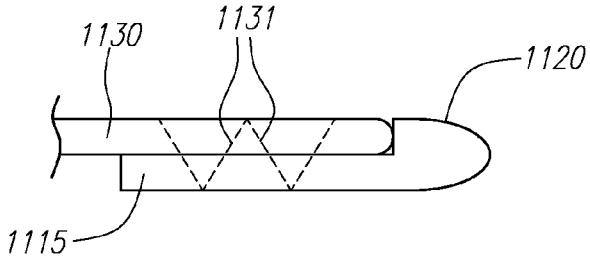

FIGS. 11A and 11B are diagrams of one example of a light ribbon 1100 with integral light sources 1106, as may be used in an illuminated garment in accordance with various embodiments as disclosed herein to illuminate the wearer. In FIG. 11A, the light ribbon 1100 may be made of silicone or other pliable material that is relatively comfortable on the skin (if exposed to the skin), although the light ribbon 1100 may alternatively be comprised of translucent or transparent material or have translucent/transparent portions. The light ribbon 1100 in this particular example has a relatively flat portion 1115 which can be attached to the fabric of a garment, and a raised portion 1120 which can serve to, among other things, house the light sources 1106, which may be embodied for example as semiconductor light elements such as LEDs. The raised portion 1120 may have a curve or bullnose shape to minimize discomfort if in contact with the skin. The raised portion 1120 alongside the flat portion 1115 creates a "step" allowing fabric 1130 to be fit or sewn into it up to the edge of the step, as illustrated in the side view diagram of FIG. 11B (with threading 1131 securing the fabric 1130 to the light ribbon 1100). The light ribbon 1100, and in particular the curved raised portion 1120, thereby can act as a garment edge when sewn or fastened. The light ribbon 1100 may act to insulate skin of the wearer against heat generated from the light sources 1106, and may also be made watertight for safety and ease of cleaning/washing. The light sources 1106 may be, for example, side-emitting LEDs, and may also combine multiple color elements (e.g., red, green and blue) in a single light source. Such multi-color LEDs are known in the art and commercially available. It may be desirable to include an electronic controller whereby the LED colors (either multiple elements in a single LED, or with different colored LEDs) can be selectively turned on or off, or increased or decreased in intensity, to generate different hues.

Figure 11C:
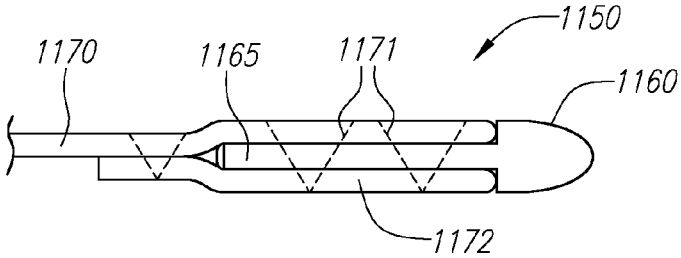
FIG. 11C is a side view diagram of another embodiment of a light ribbon.
Figure 11D:
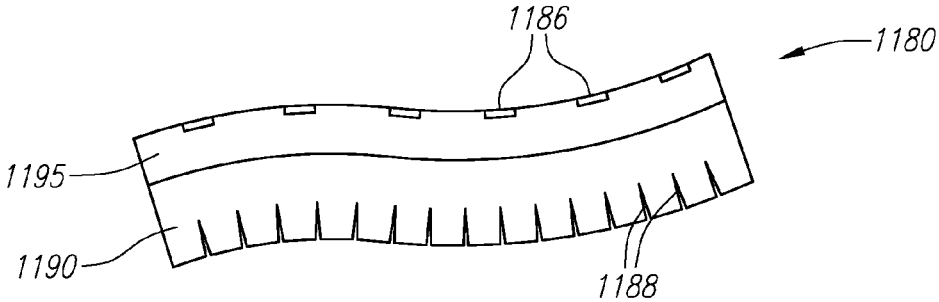
FIG. 11D is a top view diagram of a light ribbon with wedges for increased flexibility.

FIG. 11C is a side view diagram of another embodiment of a light ribbon 1150, in which the light ribbon 1150 has a flat portion 1165 terminating in a wider portion 1160. The light ribbon 1150 in FIG. 11C is similar to that shown in FIG. 11B, but it has both a top and bottom step created by the flat portion 1165 meeting the wider portion 1160, thus allowing fabric to be fit or sewn into both steps. This allows, for instance, the possibility of "sandwiching" the light ribbon 1150 between two portions of fabric 1170, 1172, for a potentially more secure attachment. FIG. 11D is a top view diagram of another variation of a light ribbon 1180, which can be based for example on either the FIG. 11B or 11C shape. Thus, the light ribbon 1180 has as flat portion 1195 and a raised or wider portion 1190 where the light sources 1186 reside. In FIG. 11D, the light ribbon 1180 has wedges 1188 for increased flexibility, allowing it to be bent more easily along the side opposite where the light sources 1186 reside. That is, the wedges stretch apart as the light ribbon 1180 is curved in a manner bringing the light sources 1186 closer together, and compress as the light ribbon 1180 is curved in a manner separating the light sources 1186 further apart. In this way, a variety of curved shapes for the light ribbon 1180 are readily achievable. The number, size and shape of the wedges 1188 illustrated in FIG. 11D are only for illustrative purposes; the number, size and shape can vary depending on particular needs and other considerations such as, e.g., the strength and durability of the ribbon material.

Figure 3:
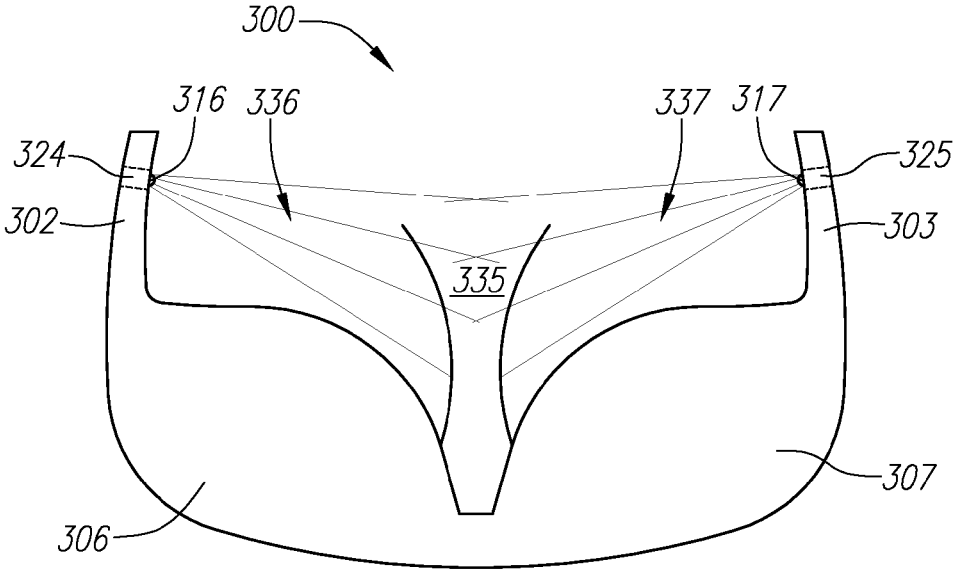
FIG. 3 is an illustration of an embodiment of an illuminated garment (e.g., a brassiere) with strap-mounted light sources for illuminating the chest area of a wearer.

FIG. 3 is an illustration of another embodiment of an illuminated garment (e.g., a brassiere) 300, with strap-mounted light sources 316, 317 for illuminating the chest area of a wearer. In FIG. 3, small pockets 324, 325 or other means may be provided for embedding strap-mounted light sources 316, 317 generally within a few inches of the top of each brassiere strap 302, 303. The light sources 316, 317 are preferably oriented so as to project their illumination (represented by 336 and 337) across the chest area of the wearer, thereby again focusing illumination on the breasts of the wearer and creating a deeper shadow along the cleavage 335, thus creating the illusion of larger/fuller breasts. More than two LEDs or other light sources may be provided.

Figure 4:
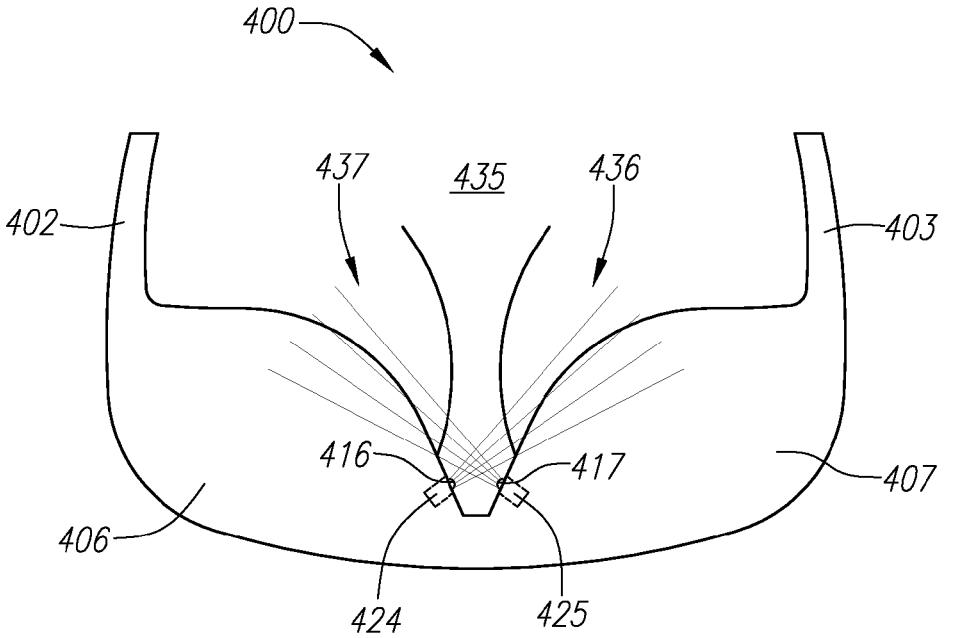
FIG. 4 is an illustration of an embodiment of an illuminated garment (e.g., a brassiere) with center-mounted light sources for illuminating the chest area of a wearer.

FIG. 4 is an illustration of yet another embodiment of an illuminated garment (e.g., a brassiere) 400 with center-mounted light sources 416, 417 for illuminating the chest area of a wearer. In this embodiment, small pockets 424, 425 or other means may be provided for embedding center-mounted light sources 416, 417 at the adjoining area between the two support cups 406, 407. The light sources 416, 417 are preferably oriented so as to project their illumination (represented by 436 and 437) upwards at a cross-angle across the chest area of the wearer, and slightly outwards, thereby focusing illumination on the breasts of the wearer and creating a deeper shadow along the cleavage 435, thus creating the illusion of larger/fuller breasts. More than two LEDs or other light sources may be provided.

The arrangements illustrated in FIGS. 3 and 4 may be combined in the same illuminated garment, and may also be combined (individually or in combination) with either of the center-cup illumination techniques illustrated for example in FIGS. 1A and 2A, or with other embodiments as described herein.

Figure 5:
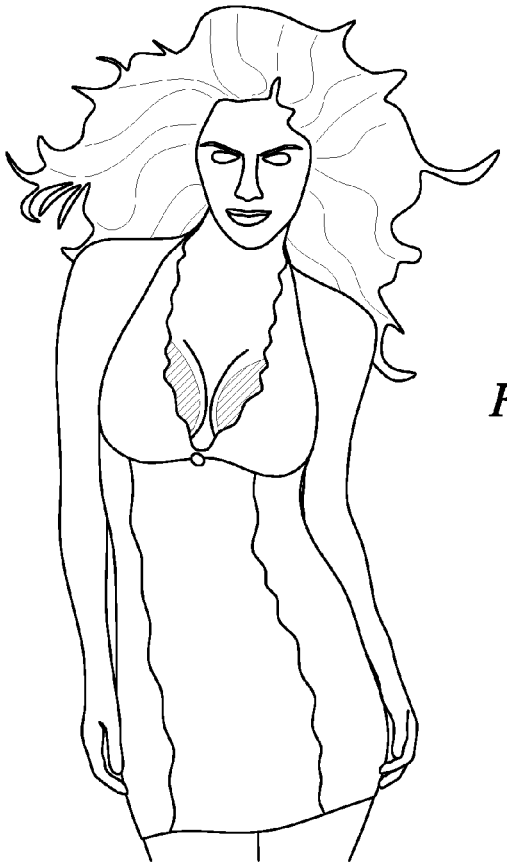
FIGS. 5, 6 and 7 are photographic illustrations of various examples of garments with concealed light sources for illuminating the skin area of a wearer.
Figure 6:
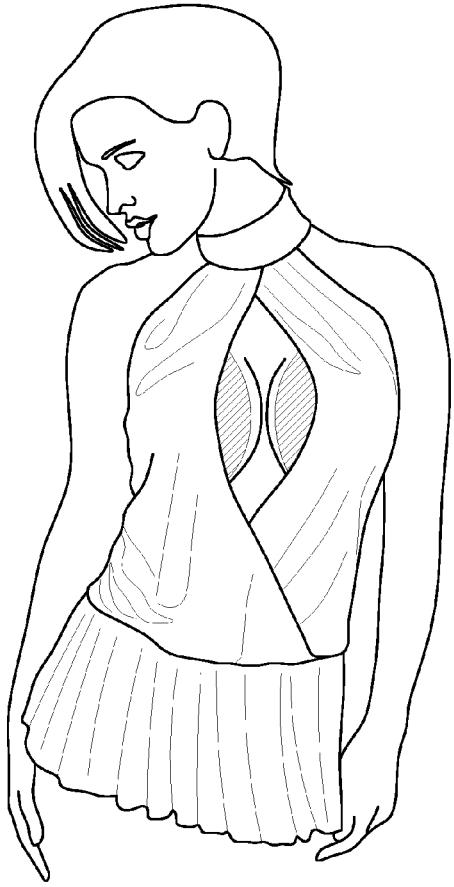
Figure 7:
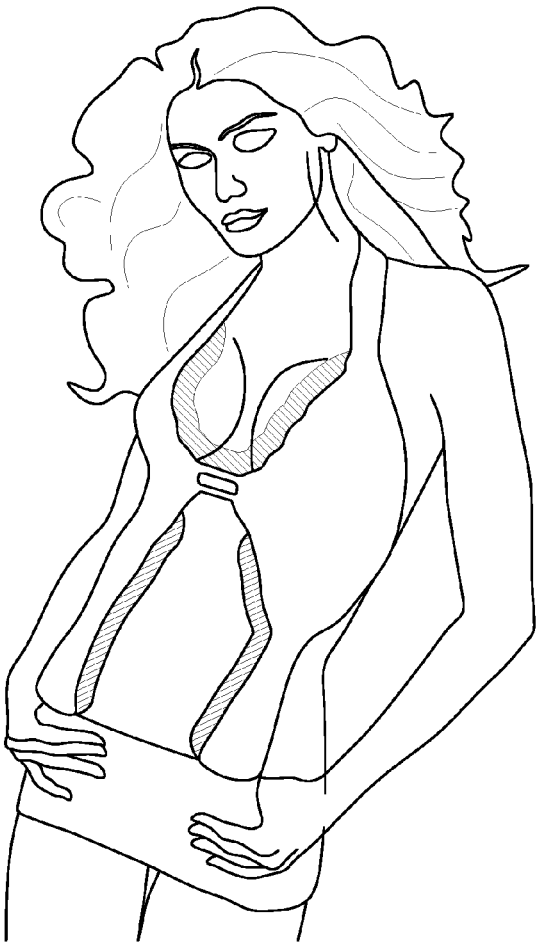

FIGS. 5, 6 and 7 are photographic illustrations of examples of various garments with concealed light sources for illuminating the skin area of a wearer with a soft direct and/or ambient light. In FIG. 5, for example, a lingerie garment is shown with illumination being provided from concealed light sources along the upper periphery of each support cup area of the garment, providing emphasis to the upper breasts while shadowing the cleavage of the wearer thus creating the illusion of deeper or larger breasts. In FIG. 6, a different type of garment is shown with a center diamond-shaped cutout above the wearer's midriff, with illumination of the wearer's bust area being provided from concealed light sources along the inner periphery of the diamond-shaped cutout along each side of the chest, providing soft illumination emphasis to the skin area of the breasts while shadowing the cleavage of the wearer. In FIG. 7, a lingerie garment is shown with illumination light being provided from concealed light sources along the upper periphery of each support cup area of the garment. Direct and/or ambient light is also provided in this example from concealed light sources beneath the support cup areas, along the upper interior periphery of the abdominal cut, washing light across each side of the upper abdomen.

Figure 8:
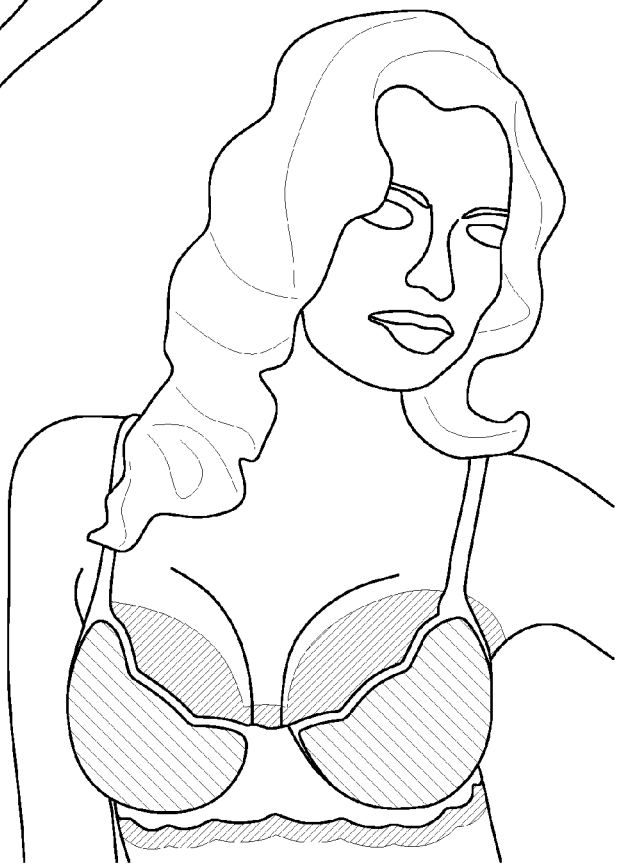
FIG. 8 is a photographic illustration of an example of a garment (e.g., a brassiere) with concealed light sources for illuminating the chest area of a wearer with a soft direct and/or ambient light and for backlighting translucent brassiere cups.

FIG. 8 is a photographic illustration of another example of an illuminated garment (e.g., a brassiere) with concealed light sources for illuminating the chest area of a wearer with a soft direct and/or ambient light and for backlighting partially translucent brassiere cups. In this example, illumination light is provided from concealed light sources along the upper periphery of each support cup area of the brassiere, while additional concealed light sources are provided around the periphery of the support cups facing inward (not outward as with the other light sources), thereby providing soft light which spills out through the partially translucent fabric of the brassiere. To achieve this effect, or variations of this effect, the inward-facing light sources may be provided along any one or more (including all) of the hems surrounding each support cup. Also, the partially translucent fabric may be sheer or "see-through" in quality, which would, among other things, increase the amount of light that would pass through the material.

Figure 9:
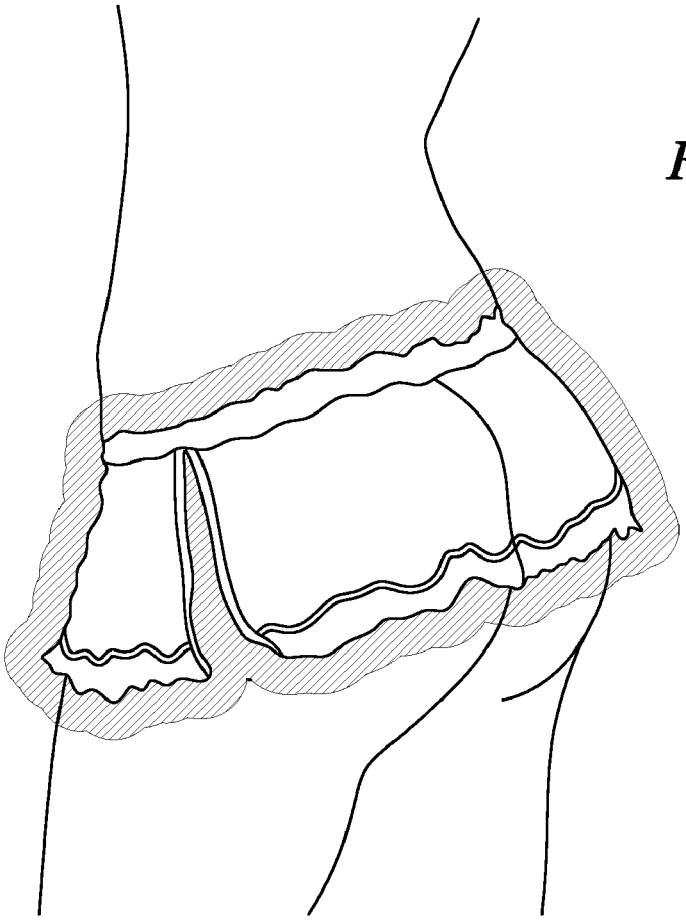
FIG. 9 is a photographic illustration of an example of lingerie garment with concealed light sources for illuminating the skin area of a wearer.
Figure 10:
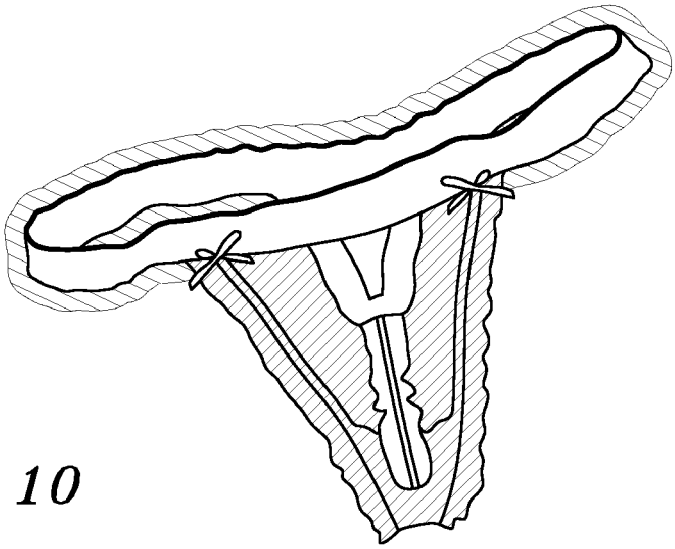
FIG. 10 depicts an example of another lingerie garment with light sources for illuminating the skin area of a wearer.

FIGS. 9 and 10 are illustrations of alternative embodiments for illuminating other parts of the wearer's body. FIG. 9 depicts an example of a lingerie garment with concealed light sources for illuminating the upper thigh or buttocks of a wearer. In this example, a short skirt or panty like garment has concealed light sources are provided around the periphery of the leggings, thus providing a soft direct and/or ambient light in much the same manner as the brassieres described earlier in FIGS. 1A and 2A. Upwardly-directed concealed lights may also be provided around the waistline to provide soft direct and/or ambient of the wearer's hips or lower abdomen. In this example, the fabric of the garment is slightly translucent, but it may be more fully translucent or else may be opaque, depending on preference. The thicker fabric along the hems helps to hide the presence of the concealed light sources.

FIG. 10 depicts an example of another lingerie garment with concealed light sources for illuminating the skin area of a wearer. In this example, concealed lights may be provided along the waistline and may be either upwardly or downwardly pointed, or both. Inwardly oriented concealed lights may also be provided along each of the hemlines surrounding the central translucent V-shaped fabric piece, thereby providing soft direct and/or ambient light below the waist.

The LEDs used in various embodiments may be surface-mount or through-hole, or may otherwise comprise any suitable LED product. A preferred color temperature for the light sources includes warm white and can be a bit golden and possibly rose/red, approximately 2800 degrees Kelvin or lower, or Tungsten that has a warm tone with a small amount of rose color, such as may be provided by LEDs (e.g., model NSPL510S) available from Nichia Corporation of Japan. Such LEDs are approximately 5 millimeters across and less than ½ inch long, thus making them suitable for many of the applications described herein. They have a small wide lens and can be jacketed with heat shrink tube to minimize stray light out the sides or back. These LEDs can be used as strap-mounted or center-mounted brassiere lights as previously described with respect to FIGS. 3 and 4, for example, to create an alluring cross light from a top vantage point (if on the upper straps) or bottom vantage point (if positioned on the center between the support cups to cross uplight the wearer's breasts). The light from these or other LEDs can, if desired, be softened with diffusion on the front lens. They may also be used as a source to illuminate a fiber optic wire that runs along the cupline of the brassiere or along the hemline of a garment. The fiber optic wire can be scraped on one side to make it side emitting, and can also be jacketed with reflective material to increase output. LEDs can be positioned on one or both ends of a suitable size (e.g., 5") fiber optic wire, one for each upper cupline of a brassiere for example.

Illuminated garments constructed according to the teachings herein may provide a soft warm light source that almost imperceptibly adds a glow (illumination) to the bustline in modern low-cut fashions, or else illuminate other exposed areas of the wearer's body. The light sources may be edge or side emitting to facilitate this effect, and may generally run along the outer edge or periphery of a brassiere or other garment thus illuminating the body starting where the apparel ends and "splashing" onto the exposed skin. The LEDs or other light sources may, for example, be encased in a soft silicone ribbon that can be sewn inside hemlines or on the exterior of the garment at the hemline (bustline etc.). They could be somewhat decorative if exposed and viewed from the front; however, it is generally preferred that the beams of light point towards and illuminate the wearer's skin. The LEDs or other light sources may also be covered, e.g. by a material reflective on the inside, so when viewed from the front the source would remain unseen. Preferably, the light source ribbon is as flat as possible, translucent (or slightly opaque to diffuse the resultant light), and water resistant or water-tight. The housing material (e.g., silicone/latex) preferably insulates the wearer from heat generated by the light source(s), a goal which may also be facilitated by using as low a voltage as possible. The edge of the ribbon may be "bullnosed" to increase comfort if in contact with the skin. It may be desirable to wire the LEDs in parallel (rather than in series) to minimize the voltage requirement of the power source. Flat or other battery packs may be required to maintain a low profile for the electronics, and a "self powered" version may utilize rechargeable batteries for storage or apply self-generated energy (from motion, heat, wearer's skin, etc.) directly to the light sources. The LEDs or other light sources may also be dimmable (using a manual control such as a gearwheel or pushbutton for instance, controlling a variable resistor or other electrical/electronic impedance or control). Preferably, the LEDs or other light sources have the appearance of a single/band(s) "cove" type source, possess enough throw (e.g. six inches approximately) to illuminate the immediate nearby skin area, and have enough lumens to effectively illuminate the skin in a fashionably dim evening environment.

A multitude of intensities, diffusion (softness/hardness), color, patterns and control options (including motion sensing effects) are possible with current technologies, and may be incorporated into any of the illuminated garment designs previously described to provide added functionality or versatility. It may also be desirable to use a plurality of color LEDs or other sources that can be mixed at different intensities to produce a wide spectrum of visible colors or changing colors that could be triggered by different means including temperature or body motion.

The illumination effects described herein may be combined with brassieres that provide mechanical enhancement of the breasts/cleavage, such as by uplifting the breasts to create a deeper cleavage, thus providing a more dramatic effect when the illumination sweeps across the chest area. Preferably, the brassiere works as an uplifting system that not only brings the breasts up but together to achieve such an effect. It may also be desirable to allow the brassiere to provide varying degrees of support/uplift, thus allowing the wearer to adjust the aesthetic effect to suit the wearer's body type or desire.

While preferred embodiments of the invention have been described herein, many variations are possible which remain within the concept and scope of the invention. Such variations would become clear to one of ordinary skill in the art after inspection of the specification and the drawings. The invention therefore is not to be restricted except within the spirit and scope of any appended claims.

What is claimed is:

1. A fashion apparel device, comprising:

a garment having a perimeter adjacent to the wearer's skin;

one or more light sources disposed on the interior of said garment proximate to said perimeter, said light sources hidden from view when the garment is worn and oriented so as direct constant visible illumination at the wearer's visible skin adjacent to said perimeter; and a portable power supply connected to said one or more light sources.

2. The fashion apparel device of claim 1, wherein said one or more light sources comprise light emitting diodes (LEDs), and wherein said portable power supply comprises a battery connected to said LEDs.

3. The fashion apparel device of claim 1, wherein said garment comprises translucent or sheer material through which the wearer's illuminated skin is visible.

4. A fashion apparel device, comprising:

a garment having a perimeter adjacent to the wearer's skin;

one or more light sources disposed on the interior of said garment proximate to said perimeter, said light sources hidden from view when the garment is worn and oriented so as direct constant visible illumination at the wearer's skin adjacent to said perimeter; and a portable power supply connected to said one or more light sources;

wherein said one or more light sources are manually adjustable in position or orientation.

5. A fashion apparel device, comprising:

a housing adapted to be worn by a person or adhered to the skin, said housing having a perimeter adjacent to the wearer's skin;

one or more light sources disposed on the interior of said housing proximate to said perimeter, said light sources shielded from view when the housing is worn and oriented so as direct constant visible illumination at the wearer's skin adjacent to said perimeter; and a portable power supply connected to said one or more light sources;

wherein said one or more light sources are manually adjustable in position or orientation.

6. The fashion apparel device of claim 5, wherein said housing is part of an item of jewelry.

7. The fashion apparel device of claim 5, wherein said housing is integral with a garment.

8. The fashion apparel device of claim 5, wherein said one or more light sources comprise light emitting diodes (LEDs), and wherein said portable power supply comprises a battery connected to said LEDs.

9. The fashion apparel device of claim 7, wherein said garment comprises translucent or sheer material through which the wearer's illuminated skin is visible.

10. An illumination system and fashion apparel apparatus, comprising:

a garment having a neckline exposing chest cleavage of a female wearer;

one or more light sources positioned proximate said garment neckline, said light sources oriented so as direct illumination at or across the wearer's cleavage and/or breasts; and a portable power supply connected to said one or more light sources;

wherein said one or more light sources comprise a plurality of LEDs integrated into a flexible silicone ribbon attached onto the hemline of said garment and having a bullnosed or otherwise light-emitting edge running along the edge of said garment opening, one or more of said LEDs positioned to face substantially towards said garment opening while remaining concealed from view, so as to direct light at and across the exposed skin of the wearer.

* * * * *